US005833236A

United States Patent [19]

Oursler et al.

[11] Patent Number: 5,833,236

[45] Date of Patent: Nov. 10, 1998

[54] WRECKING BALL PLAY FEATURE FOR A PINBALL GAME

[75] Inventors: Barry Oursler, Lake Zurich, Ill.; Dwight Sullivan, Streamwood, Ill.

[73] Assignee: Williams Electronics Games, Inc., Chicago, Ill.

[21] Appl. No.: 920,301

[22] Filed: Aug. 28, 1997

[51] Int. Cl.[6] ..... A63F 7/30

[52] U.S. Cl. ..... 273/127 R; 273/119 A; 273/121 A

[58] Field of Search ..... 273/118, 119, 273/121, 127 R, 127 B, 127 D; 446/4, 6, 137, 129, 424, 425, 426, 427, 238, 434, 465, 470, 336

[56] References Cited

U.S. PATENT DOCUMENTS

| | | | |
|---|---|---|---|
| 2,316,680 | 4/1943 | Ferri | 446/129 X |
| 2,623,774 | 12/1952 | Hubbard | 446/425 X |
| 3,204,965 | 9/1965 | Engle | 273/119 R |
| 3,704,889 | 12/1972 | Huffman et al. | 273/119 R |
| 3,770,276 | 11/1973 | Breslow | 273/119 R |
| 3,997,061 | 12/1976 | Sano | 446/426 X |
| 5,356,142 | 10/1994 | Borg et al. | 273/121 A |
| 5,533,726 | 7/1996 | Nordman et al. | 273/121 A X |

FOREIGN PATENT DOCUMENTS

| | | | |
|---|---|---|---|
| 1356524 | 2/1964 | France | 446/129 |

*Primary Examiner*—Raleigh W. Chiu
*Attorney, Agent, or Firm*—Rudnick & Wolfe; William T. Rifkin; R. Blake Johnston

[57] ABSTRACT

A wrecking ball play feature for a pinball game includes a crane disposed upon the playfield of the pinball game. A wrecking ball is suspended from the crane by a cable so that it may be impacted by a game ball rolling upon the playfield. After being struck by the game ball, the wrecking ball swings in a pendulum-like fashion so as to strike targets near the crane, thus increasing the player's score. Alternatively, the wrecking ball may block a passage, the access of which by the game ball increases the player's score. The wrecking ball may be raised or lowered so that the pinball game features two or more modes of play. In one embodiment, the wrecking ball is raised and lowered by pivoting the crane arm about a pivot connection with the crane tower by way of a solenoid connected between the crane arm and the playfield. In another embodiment, the wrecking ball is raised by retracting the cable into the crane arm by way of tilting a crank to which the cable is connected.

13 Claims, 4 Drawing Sheets

WRECKING BALL PLAY FEATURE FOR A PINBALL GAME

BACKGROUND

The invention relates generally to amusement devices in the form of rolling ball or pinball games and, more particularly, to a wrecking ball play feature for such games.

A typical pinball game includes a playfield that is inclined so that a game ball rolling thereon is directed by gravity towards the player. This movement is counteracted when the game ball comes into contact with pivoting flippers that are controlled by the player. These flippers allow the player to propel and direct the game ball at various play features mounted upon the playfield. By engaging the play features with the game ball, the player is able to score points and control play of the game.

Pinball games derive their appeal from the novel construction and arrangement of the play features. As such, to attract players to a game, it is necessary to provide new, exciting and challenging play features that test the player's skill in addition to entertaining the player. While existing play features such as targets, ramps, bumpers and the like may be arranged in a variety of positions and configurations, a new and novel play feature generates more player curiosity and interest. Furthermore, since game challenge decreases as players become more skilled at a game, a new and novel play feature would test a player's skill in new and exciting ways and thus enhance the appeal of a game.

Accordingly, it is an object of the present invention to provide a novel play feature for a pinball game which attracts and entertains players.

SUMMARY

The present invention is directed to a wrecking ball play feature for a pinball game. The wrecking ball play feature includes a crane tower that is secured to the playfield of the pinball game. A crane arm is connected to the upper portion of the crane tower and a "wrecking ball" is suspended from the crane arm by a cable. As such, the wrecking ball may be struck by a properly directed game ball rolling upon the playfield.

The impact of the game ball with the wrecking ball causes the latter to swing in a pendulum-like fashion so that targets placed near the crane may be struck to increase the player's score. These targets are disposed upon an elevated base so that they cannot be struck by the game ball. In addition, the suspended wrecking ball may partially or completely block the entrance to a passage through the base. Accessing this passage with the game ball could allow a player to increase his score or enter an otherwise restricted portion of the playfield. In such a configuration, it would be necessary for the player to strike the wrecking ball with the game ball before obtaining access to the passage.

The play feature may also include the ability to raise and lower the wrecking ball with respect to the playfield so that the game ball may engage the wrecking ball only when the latter is in proximity to the playfield. This allows the pinball game to have two or more modes of play. In one such embodiment of the invention, a pivot connection exists between the crane arm and the upper portion of the crane tower. A solenoid is connected between the crane arm and the playfield so that the crane arm may be tilted about the pivot connection so as to raise or lower the wrecking ball when the solenoid is activated.

In another embodiment of the invention, the wrecking ball is raised by retracting the cable into a crane arm that is fixedly attached to the crane tower. This is accomplished by the rotation of a crank, to which the cable is attached, that is pivotally connected to the crane tower. Rotation of the crank is also accomplished by the use of a solenoid.

For a more complete understanding of the nature and scope of the invention, reference may now be had to the following detailed description of embodiments thereof taken in conjunction with the appended claims and accompanying drawings.

DESCRIPTION

Figure 1:
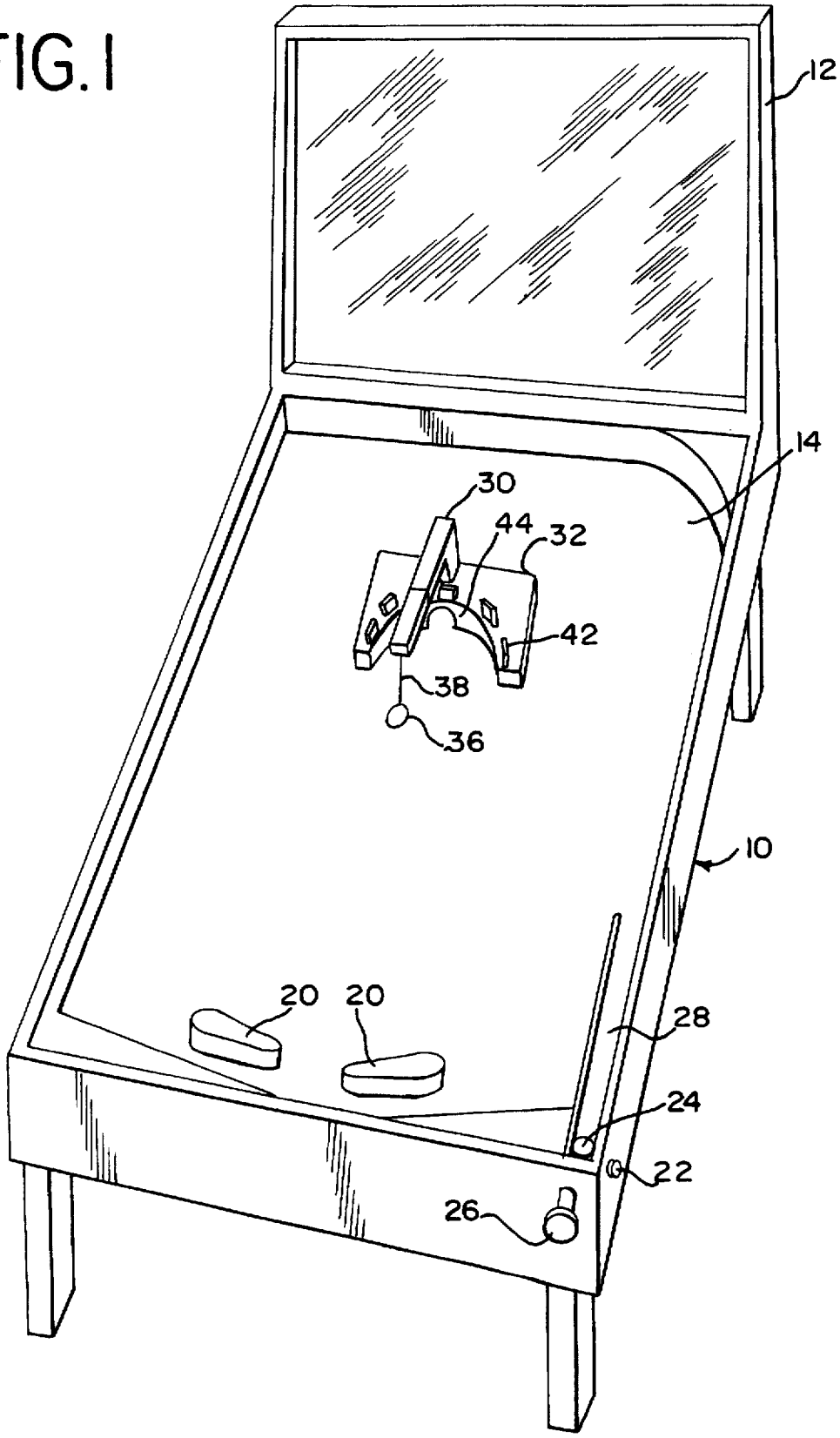
FIG. 1 is a perspective view of a pinball game including the play feature of the invention.

Referring to FIG. 1, a pinball game is shown that features an embodiment of the wrecking ball play feature of the invention. The pinball game is housed in a game cabinet, indicated generally at 10, that features a vertical back box 12 and a playfield 14. The playfield is inclined so that a ball positioned thereon is directed by gravity away from back box 12 and towards the player of the game. A pair of pivoting flippers 20 are positioned at the bottom of the inclined playfield 14 and are actuated by the player via manipulation of flipper control switches 22. As is known in the art, game ball 24 is introduced onto playfield 14 by way of a spring loaded shooter 26 or equivalent which shoots the ball into a shooter lane 28. After being "shot" onto the playfield 14, the ball rolls towards the player by the force of gravity. The player actuates flippers 20 so that they contact the game ball thus propelling and directing it towards targets on the playfield. The player's score and progress are displayed upon back box 12.

Disposed upon playfield 14 is crane 30. Crane 30 is mounted upon a base 32 which has a height slightly greater then that of game ball 24. A wrecking ball 36 is suspended from crane 30 via cable 38 so that it may swing freely when contacted by game ball 24. Mounted on or adjacent to base 32 are targets 42. These targets are positioned at an elevation above the playfield 14, and a distance from the base of crane 30, that allows them to potentially be engaged by wrecking ball 36 (but not the game ball 24) as it oscillates after being struck by game ball 24. As such, a player may use flippers 20 to direct and propel game ball 24 towards wrecking ball 36 so that the latter strikes one or more of the targets 42.

Passing through base 32 is a passage 44. Playfield 14 may be configured so that passing the game ball 24 through passage 44 increases the player's score or allows the game ball to access an otherwise restricted portion of the playfield. Wrecking ball 36 is positioned so as to make access to passage 44 more challenging to the player. In other words, to gain access to passage 44, the player must use flippers 20 to propel the game ball with sufficient velocity that wrecking ball 36 is first knocked out of the way or, alternatively, the player must direct the game ball around wrecking ball 36, for example with a bank shot.

Crane 30 may optionally feature the capability to lift wrecking ball 36 away from playfield 14. By doing so, the angle of impact between the game ball and wrecking ball 36 may change or, alternatively, wrecking ball 36 may be elevated to a position where the game ball may not contact it at all. This allows the game to provide two or more modes of play. For example, wrecking ball 36 may initially be elevated so that it is inaccessible by the game ball and then, when the player accumulates enough points or strikes a "jackpot" target, it may be lowered to allow the player to strike targets 42. As another example, wrecking ball 36 could initially be in a lowered position that completely prevents access to passage 44. The player could use wrecking ball 36 to strike targets 42 until enough points are accumulated or a "jackpot" target is struck to raise wrecking ball 36 and allow access to passage 44.

It should be noted that the configurations of base 32, targets 42 and passage 44 are presented as examples only and that a wide variety of entertaining variations using crane 30 and wrecking ball 36 are possible.

Figure 2:
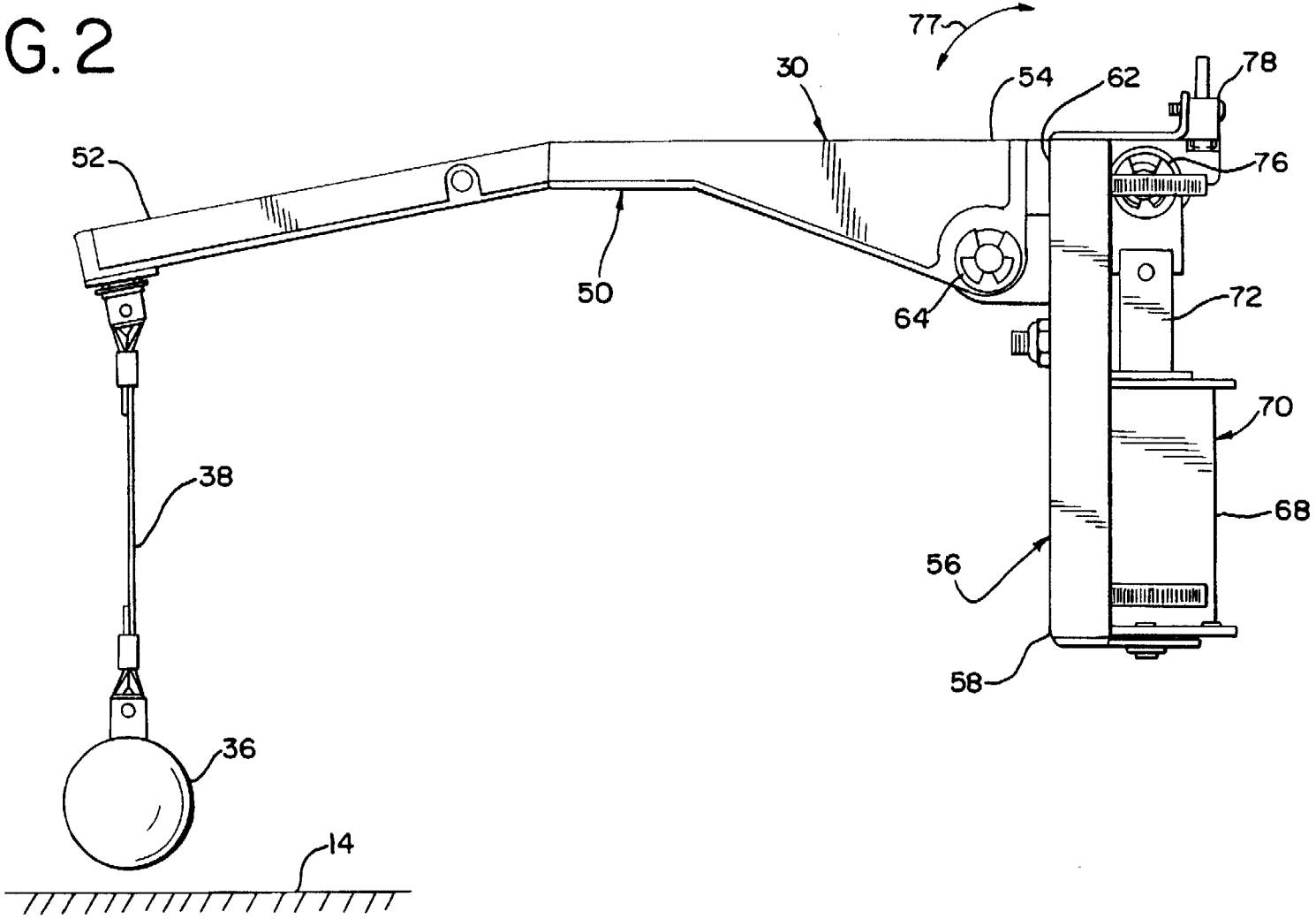
FIG. 2 is a side view of an embodiment of the play feature of the invention.

FIG. 2 shows the details of a first embodiment of crane 30. Crane 30 features a crane arm 50 that includes a distal portion 52 and a proximate portion 54. Crane arm 50 is supported by crane tower 56 which is affixed by its bottom portion 58 to base 32 (FIG. 1) or to playfield 14, if desired. As noted previously, wrecking ball 36 is suspended from distal portion 52 of crane arm 50 by cable 38. The proximate portion 54 of crane arm 50 is attached to the upper portion 62 of crane tower 56 by pivot connection 64. As such, crane arm 50 is able to tilt relative to crane tower 56.

Attached to crane tower 56 is the coil 68 of solenoid 70. Plunger 72 of solenoid 70 is attached by pivot connection 76 to the proximate portion 54 of crane arm 50. As a result, activation of solenoid 70 causes crane arm 50 to tilt about pivot connection 64 as suggested by arrow 77. This causes wrecking ball 36 to be lifted or lowered relative to the playfield. Activation of solenoid 70 may be controlled by a microprocessor (not shown) that monitors the progress of the game. The status of the wrecking ball 36, that is, whether it is raised or lowered, may be detected by a micro switch 78 which is in communication with the microprocessor.

Figure 3:
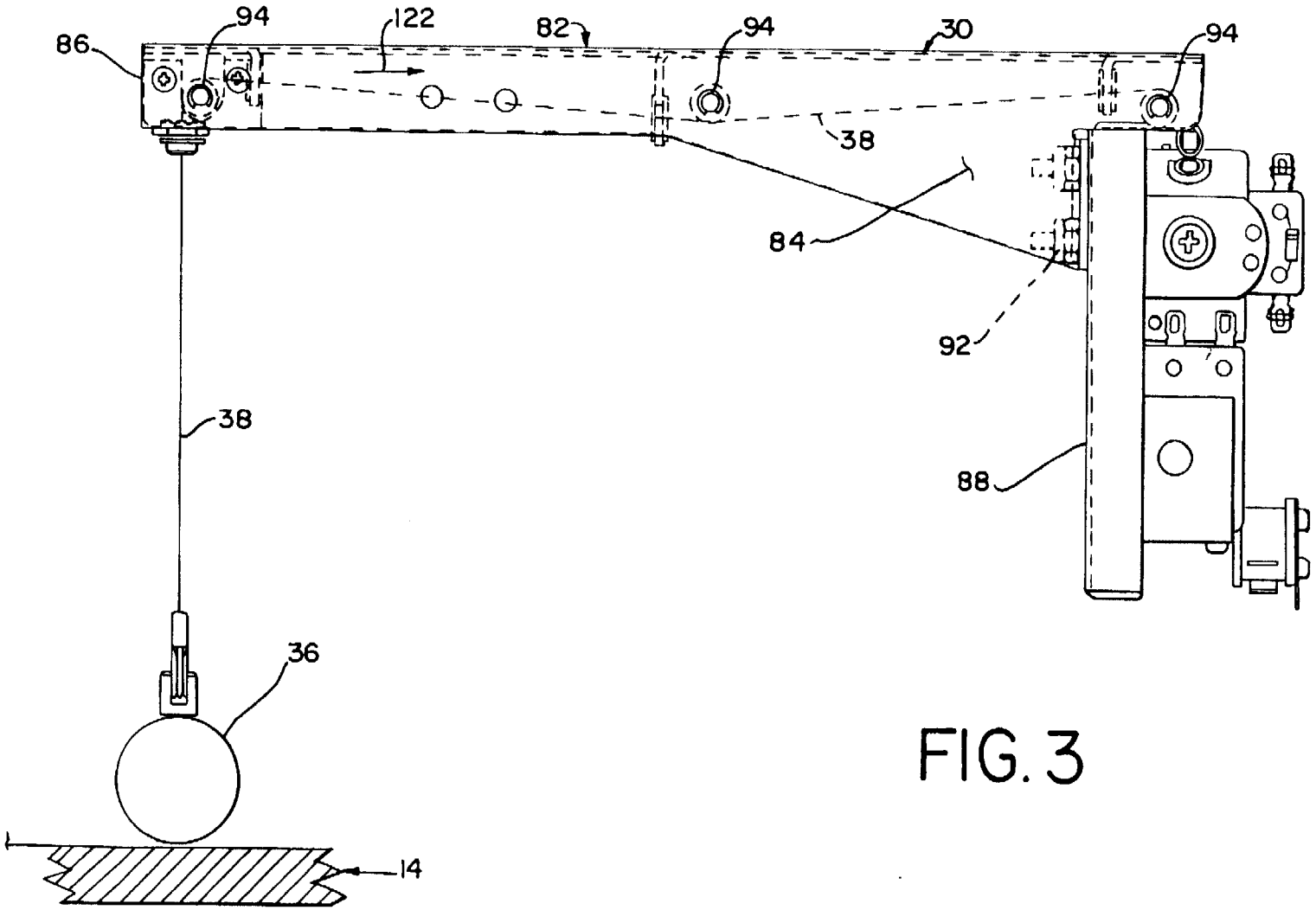
FIG. 3 is a partial section side view of an alternative embodiment of the play feature of the invention.

An alternative embodiment of crane 30 is shown in FIG. 3. Similar to the embodiment of FIG. 2, the crane features a crane arm 82 with a proximate portion 84 and a distal portion 86. In addition, the crane includes a crane tower 88 attached by its lower portion to playfield 14. In this embodiment, however, crane arm 82 is fixedly attached to the upper end of crane tower 88 by bolts 92. Cable 38, with wrecking ball 36 attached to its distal end, has an extended length that is guided through crane arm 82 by rollers 94.

Figure 4:
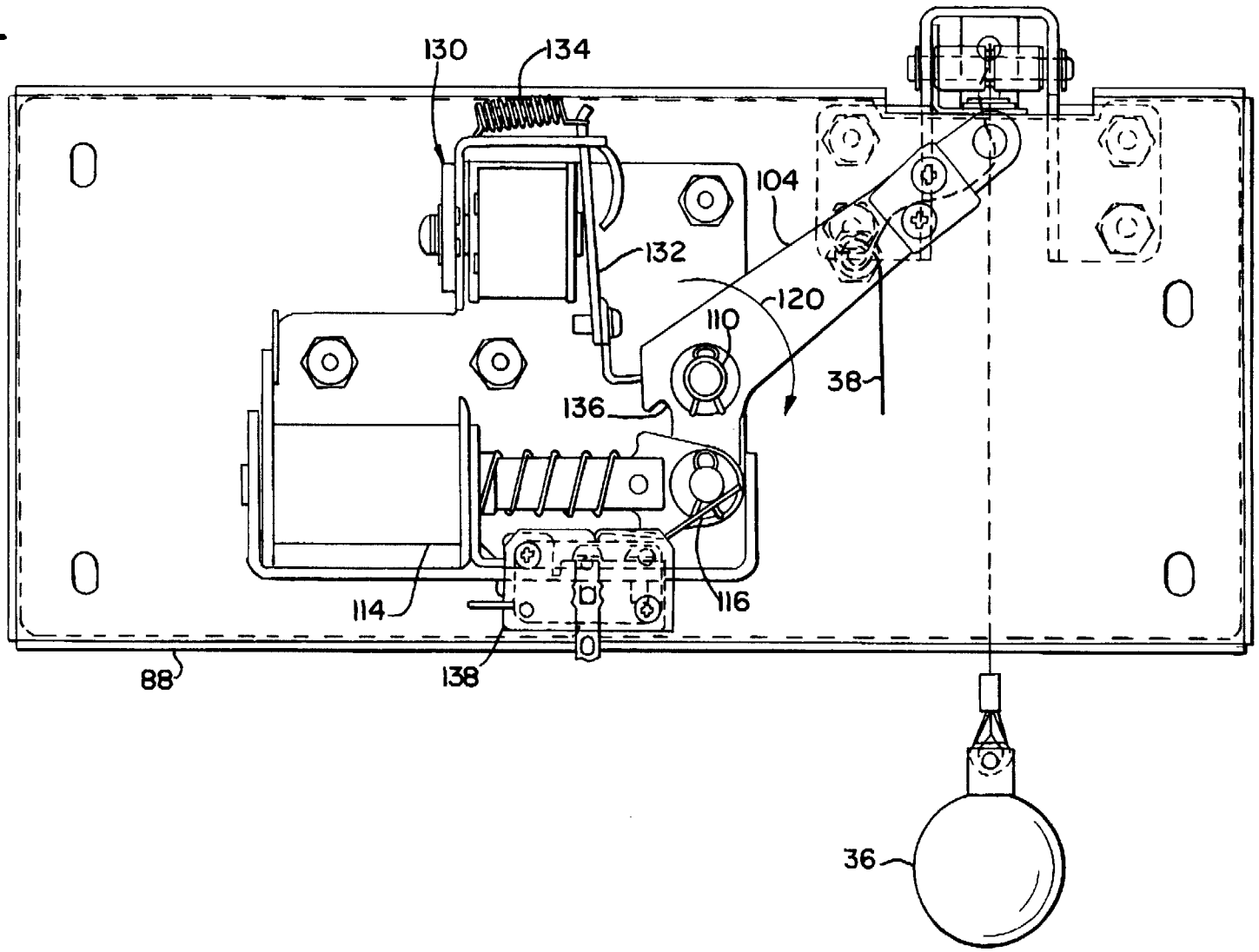
FIG. 4 is a rear view of the play feature of FIG. 3.

Referring to FIG. 4, the proximate end of cable 38 is attached to a linkage that raises and lowers wrecking ball 36 by drawing cable 38 into the crane arm. The linkage includes a crank 104 that is pivotally attached to crane tower 88 by pivot connection 110 and to solenoid 114 via pivot connection 116. Solenoid 114 is also fixedly attached to crane tower 88. As a result, when solenoid 114 is actuated, crank 104 pivots in a clockwise direction, as indicated by arrow 120, and the proximate end of cable 38 is pulled downwards. This results in wrecking ball 36 being lifted away from playfield 14 so that the contact angle of the game ball with wrecking ball 36 would be changed. Alternatively, wrecking ball 36 may be elevated to a height that prevents contact between the game ball and wrecking ball 36.

Positioned above solenoid 114 is a magnetic switch 130. Magnetic switch 130 engages crank 104 so that wrecking ball 36 is locked in an elevated position. More specifically, switch arm 132, due to the action of spring 134, engages a notch 136 in crank 104 when crank 104 has been rotated clockwise, as indicated by arrow 120, and wrecking ball 36 is in an elevated position. When magnetic switch 130 is activated, switch arm 132 is urged out of notch 136 so that crank 104 is free to rotate counterclockwise about pivot connection 110. As a result of this rotation, wrecking ball 36 is lowered towards the playfield. Magnetic switch 130 and solenoid 114 may be controlled by a microprocessor (not shown) and the position of the wrecking ball 36 may be monitored by a micro switch 138.

While the preferred embodiments of the invention have been shown and described, it will be apparent to those skilled in the art that changes and modifications may be made therein without departing from the spirit of the invention, the scope of which is defined by the appended claims.

What is claimed is:

1. In a pinball game having an inclined playfield for supporting at least one game ball thereon the improvement comprising a play feature including:

a) a crane tower having an upper portion and a lower portion, said lower portion of the crane tower connected to said playfield;

b) a crane arm attached to the upper portion of the crane tower;

c) a wrecking ball;

d) a cable suspending said wrecking ball from the crane arm; and e) means for raising and lowering said wrecking ball with respect to the playfield so that said wrecking ball may be selectively engaged by a game ball.

2. The wrecking ball play feature of claim 1 wherein the means for raising and lowering the wrecking ball includes:

a) a pivot mounting for connecting the crane arm to the crane tower; and b) a solenoid mounted to said crane tower and connected to the crane arm for tilting the crane arm with respect to the crane tower.

3. The wrecking ball play feature of claim 2 further comprising means for detecting a position of the wrecking ball.

4. The wrecking ball play feature of claim 1 wherein the means for raising and lowering the wrecking ball includes means for retracting said cable into the crane arm to raise the wrecking ball.

5. The wrecking ball play feature of claim 4 wherein the means for retracting said cable includes:

a) a crank, a first end of which is connected to the cable and a second end of which is pivotally connected to the crane tower; and b) a solenoid mounted on the crane tower and connected to said second end of the crank so that the wrecking ball may be raised and lowered.

6. The wrecking ball play feature of claim 3 further comprising means for detecting a position of the wrecking ball.

7. A wrecking ball play feature for a pinball game having a play field and a game ball comprising:

a) a crane adapted to be positioned upon the play field;

b) a wrecking ball;

c) a cable suspending said wrecking ball from said crane; and d) means for controlling the elevation of the wrecking ball relative to the playfield so that the wrecking ball may only be engaged when in proximity to the playfield.

8. The wrecking ball play feature of claim 7 further comprising:

a) a base on which the crane is mounted and which in turn is adapted to be secured to said playfield; and b) at least one target disposed on the base which cannot be engaged by the game ball but may be engaged by said wrecking ball when said wrecking ball is struck by said game ball.

9. The wrecking ball play feature of claim 8 further comprising a passage through said base, the passage having an entrance that is at least partially blocked by the wrecking ball when it is at rest.

10. The wrecking ball play feature of claim 7 further comprising:

a) a base on which the crane is mounted and which in turn is adapted to be secured to said playfield; and b) a passage through said base, the passage having an entrance that is at least partially blocked by the wrecking ball when it is at rest.

11. The wrecking ball play feature of claim 7 further comprising:

a) a base on which the crane is mounted and which in turn is adapted to be secured to said playfield; and b) at least one target disposed on the base and above the playfield which cannot be engaged by the game ball but may be engaged by said wrecking ball when said wrecking ball is struck by said game ball.

12. The wrecking ball play feature of claim 11 further comprising a passage through said base, the passage having an entrance that is at least partially blocked by the wrecking ball when it is in proximity to the playfield and at rest.

13. The wrecking ball play feature of claim 11 further comprising:

a) a base on which the crane is mounted and which in turn is adapted to be secured to said playfield; and b) a passage through said base, the passage having an entrance that is at least partially blocked by the wrecking ball when it is at rest.

* * * * *